United States Patent [19]

Kranis, Sr. et al.

[11] Patent Number: 5,001,922

[45] Date of Patent: Mar. 26, 1991

[54] QUICK CHANGE TOOLING FOR PRESS MACHINE

[75] Inventors: Daniel Kranis, Sr., Wernersville, Pa.; Jan C. Turczynski, Hopkinsville, Ky.; Peter A. Calabrese, Minersville, Pa.

[73] Assignee: Dana Corporation, Toledo, Ohio

[21] Appl. No.: 430,189

[22] Filed: Nov. 1, 1989

[51] Int. Cl.[5] ..... B21D 37/02

[52] U.S. Cl. ..... 72/413; 72/397; 72/461; 72/477; 72/481

[58] Field of Search ..... 72/481, 413, 476, 313, 72/396, 397, 461, 477; 100/228, 255

[56] References Cited

U.S. PATENT DOCUMENTS

| | | | |
|---|---|---|---|
| 2,837,135 | 6/1958 | Demler | 72/481 |
| 3,323,348 | 6/1967 | Pearson | 72/413 |
| 3,610,019 | 2/1970 | Denninger | 72/477 |
| 3,702,560 | 11/1972 | Weidel . | |
| 3,826,119 | 7/1974 | Marotto | 72/461 |
| 3,848,494 | 11/1974 | Gargrave et al. . | |
| 3,908,435 | 9/1975 | Bowman, Jr. et al. . | |
| 3,927,548 | 12/1975 | Lannin | 72/382 |
| 3,949,589 | 4/1976 | Johnson et al. . | |
| 3,990,291 | 11/1976 | Evertz et al. | 72/382 |
| 4,086,837 | 5/1978 | Dyck . | |
| 4,151,736 | 5/1979 | Quaas . | |
| 4,152,978 | 5/1979 | Abe et al. . | |
| 4,158,955 | 6/1979 | Bustin | 72/461 |
| 4,160,372 | 7/1979 | Bergman et al. . | |
| 4,192,168 | 3/1980 | DiCiaccio . | |
| 4,274,332 | 6/1981 | Nakamura . | |
| 4,403,495 | 9/1983 | Talbot . | |
| 4,570,474 | 2/1986 | Tanaka et al. . | |
| 4,587,830 | 5/1986 | Mills . | |
| 4,611,484 | 9/1986 | Mackissinger, Jr. et al. . | |
| 4,698,894 | 10/1987 | Lingaraju et al. . | |
| 4,791,803 | 12/1988 | Broquet et al. . | |
| 4,825,682 | 5/1989 | Orav et al. | 72/477 |
| 4,878,374 | 11/1989 | Nelson | 100/228 |

*Primary Examiner*—David Jones

*Attorney, Agent, or Firm*—MacMillan, Sobanski & Todd

[57] ABSTRACT

Tools and tool supports in a press which permit a tool changeover operation to be performed quickly and easily are disclosed. A pivot arm is carried on a ram of the press. A punch has an aperture formed therethrough, allowing it to be slidably mounted on the pivot arm. The punch is normally retained by a keeper for use in a first operating position on the pivot arm. The punch may be reversed for use in a second operating position by raising the keeper out of its retaining position and moving the punch along the pivot arm toward a second position. There, the punch can be rotated one hundred eighty degrees about the pivot arm. Then, the punch is moved back to the first position. The keeper automatically retains the reversed punch adjacent to the first support block when the punch is moved back to its original position. To remove the punch from the pivot arm, a retainer pin is removed, allowing one end of the pivot arm to pivot away from the ram. The punch is then removed from the pivot arm, allowing a new punch to be installed thereon. A pivot block assembly supports the workpiece on the base plate when engaged by the tool. The assembly includes a pivot lid having a flat upper surface. The pivot lid is pivotably mounted on the base plate such that the upper surface thereof is pivoted to lie flat against the lower surface of the workpiece when the tool bends the workpiece.

16 Claims, 8 Drawing Sheets

QUICK CHANGE TOOLING FOR PRESS MACHINE

BACKGROUND OF THE INVENTION

This invention relates in general to tooling for mechanical power press machines and in particular to improved structures for tools and tool supports for such a press which permit a tool changeover operation to be performed quickly and easily.

The mechanical power press is a widely known machine which is frequently used to perform many metal forming operations, such as forming, blanking, and the like. A typical press includes an upper ram, which is secured to a movable slide of the press, and a lower bolster, which is secured to a stationary bed or base of the press. Before using the press, an upper tool, such as a punch or an upper die section, is attached to the ram. Similarly, a lower tool, such as a die or lower die section, is attached to the bolster. A workpiece is then positioned within the press between the tools. When the workpiece is properly positioned, a motor is energized to move the upper tool downwardly toward the lower tool. As a result, the workpiece is engaged therebetween with a predetermined amount of force. The tools are designed to form the workpiece into a desired shape when they are moved together in this manner.

A major problem associated with presses of this type is that a relatively long length of time is usually required to perform a tool changeover operation. Such an changeover operation is necessary when it is desired to form a workpiece into a different shape or when differently shaped workpieces are being formed. The tool changeover operation involves removing the existing upper and lower tools from the press and replacing them with differently shaped tools. The removal and replacement of these tools is a time consuming process and inefficient process, particularly in large presses for forming heavy or bulky workpieces such as side rails for vehicle frames. In these instances, the tools themselves are very large and heavy, and the changeover operation is slowed by the difficulty in handling such tools. It is not uncommon for a changeover operation of this type to consume three to fours hours or more. Accordingly, it would be very desirable to provide tool and tool support structures in such presses which permit the tools to be quickly and easily changed.

SUMMARY OF THE INVENTION

This invention relates to improved structures for both tools and tool supports in a power press machine which permit a tool changeover operation to be performed quickly and easily. A ram of the press carries first and second support blocks thereon for supporting the ends of a pivot arm. An upper tool, such as a punch, has an aperture formed therethrough, allowing it to be slidably mounted on the pivot arm. The punch is normally retained adjacent to the first support block by a keeper for use in a first operating position. The punch may be reversed for use in a second operating position by raising the keeper out of its retaining position and moving the punch along the pivot arm away from the first support block toward the second support block. Then, the punch is rotated one hundred eighty degrees about the pivot arm and moved back toward the first support block. The keeper automatically retains the reversed punch adjacent to the first support block when the punch is moved back to its original position. To remove the punch from the pivot arm, a retainer pin is removed, allowing one end of the pivot arm to pivot away from the associated support block. The punch is then removed from the pivot arm, and a new punch is installed thereon. A lower tool, such as a pair of opposed dies, is mounted on a base plate of the press. A pair of die holders are provided to retain the dies in desired positions relative to the punch. Differently sized positioning pins are provided in the die holders to insure that the dies are properly oriented. The dies can be switched so as to be retained in the opposite die holders when the punch is rotated one hundred eighty degrees, as mentioned above, or can be replaced when the punch is replaced, also as mentioned above.

It is an object of this invention to provide improved structures for tools and tool supports in a power press machine which permit a tool changeover operation to be performed quickly and easily.

It is another object of this invention to provide such improved tool and tool support structures which are simple and inexpensive in construction and operation.

Other objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
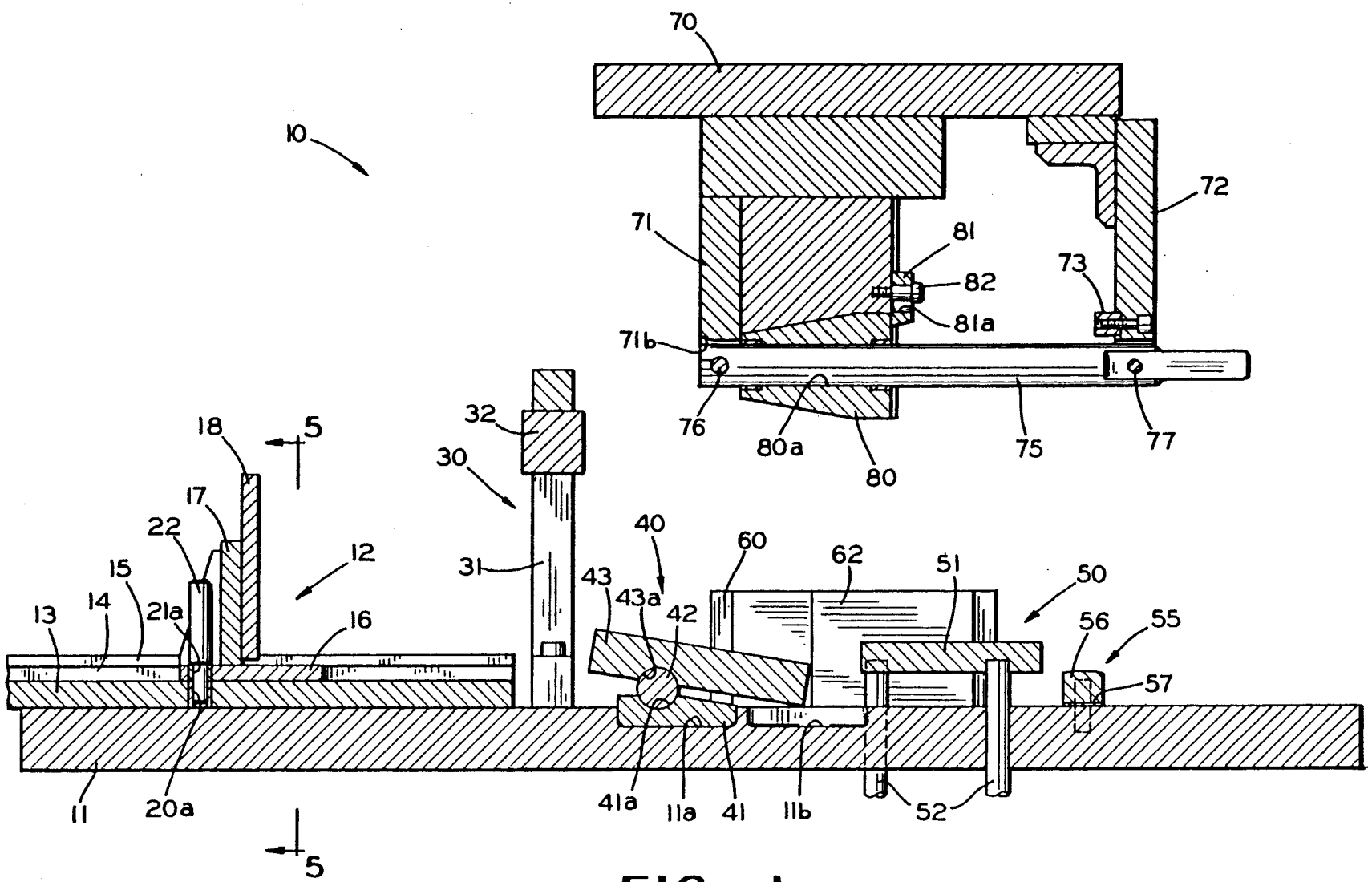
FIG. 1 is a side elevational view of a portion of a press having improved tool and tool support structures in accordance with this invention.

Referring now to the drawings, there is illustrated a portion of a power press machine, indicated generally at 10. The basic structure and operation of the press 10 is well known in the art. Therefore, only that portion of the press 10 which is helpful to the understanding of this invention will be described and illustrated. The press 10 includes a stationary elongated lower base plate 11. The base plate 11 is secured to a fixed frame (not shown) for the press 10 and generally defines a longitudinal axis 10a through the press 10.

Figure 4:
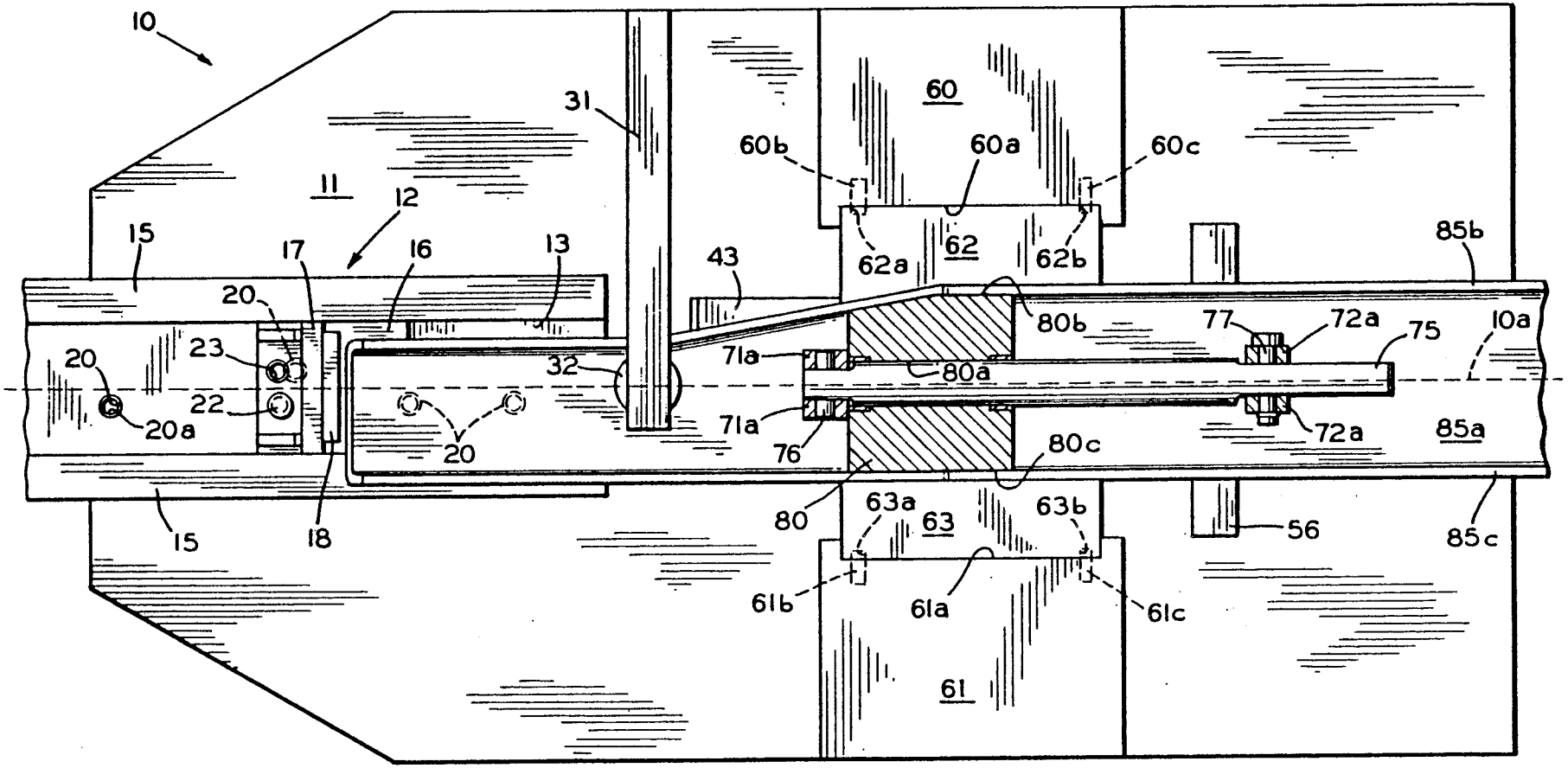
FIG. 4 is a top plan view of the press during the forming operation, portions of the upper parts of the press being broken away for clarity.
Figure 5:
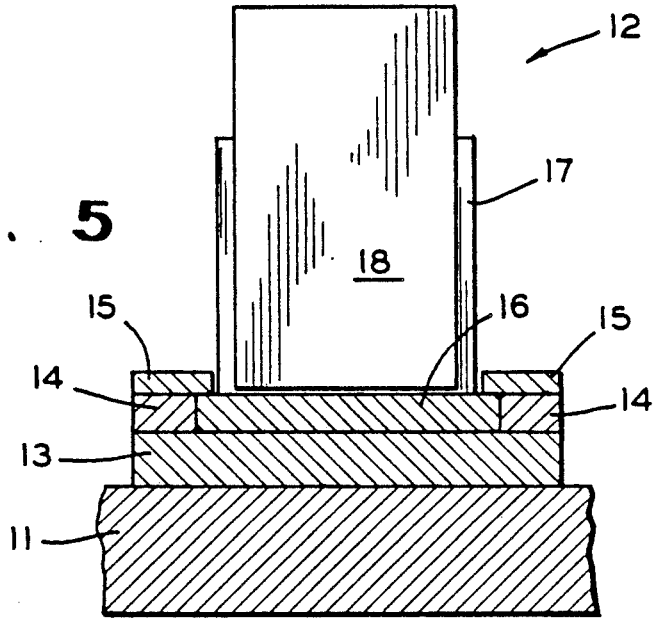
FIG. 5 is a sectional elevational view taken along line 5—5 of FIG. 1 showing the adjustable stop mechanism.

Near one end of the base plate 11 (the left end when viewing FIG. 1), a slide base assembly, indicated generally at 12, is provided. The structure of the slide base assembly is best shown in FIGS. 1, 4, and 5. As shown therein, the slide base assembly 12 includes a bottom plate 13, which is secured to the base plate 11. A pair of spacer bars 14 are secured to the bottom plate 13 in spaced apart fashion. Keeper bars 15 are attached to each of the spacer bars 14 and, therefore, are also spaced apart from one another. As best shown in FIG. 5, the width of the space defined between the spacer bars 14 is greater than the width of the space defined between the keeper bars 15. It will be readily appreciated that the bottom plate 13, the spacer bars 14, and the keeper bars 15 are all fixed in position relative to the base plate 11.

The slide base assembly 12 further includes a movable stop assembly, which is formed by a stop base 16, an upstanding back-up plate 17, and a stop plate 18. The stop base 16 is disposed adjacent to the bottom plate 13 between the spacer bars 14. The width of the stop plate 16 is slightly less than the width of the space defined between the spacers bars 14, but is greater than the width of the space defined between the keeper bars 15. Thus, the stop base 16 is permitted to slide along the longitudinal axis **10*a* of the press 10, but is retained within the slide base assembly 12 by the keeper bars 15. The upstanding back-up plate 17 is secured to the stop base 16, and the stop plate 18 is secured to the back-up plate 17, both for movement with the stop base 16 along the longitudinal axis 10*a* of the press 10**.

Means are provided for selectively retaining the movable stop assembly in any one of a plurality of desired positions relative to the slide base assembly 12. As best shown in FIG. 4, the desired positions are defined by a plurality of bores 20 formed in the bottom plate 13. A bushing **20*a* is pressed into each of the bores 20. An aperture 21 is formed through the stop base 16, and a bushing 21*a* is pressed therein. To retain the movable stop assembly in a desired position, the aperture 21 formed through the stop base 16 is initially aligned with a desired one of the bores 20 formed in the bottom plate 13. Then, a retaining pin 22 is inserted through the aperture 21 into the aligned bore 20. When so inserted, the retaining pin 22 prevents the movable stop assembly from moving relative to the slide base assembly 12. When it is desired to move the movable stop assembly to another position, the retaining pin 22 is removed, the aperture 21 is aligned with a different one of the bores 20, and the retaining pin 22 is re-inserted through the aperture 21 into the desired bore 20**.

As shown in FIG. 4, five bores 20 are formed in the bottom plate 13. Four of these bores 20 (the lower four when viewing FIG. 4) are co-axially aligned along a line which is parallel to, but offset below the longitudinal axis **10*a* through the press 10. The aperture 21 formed through the stop base 16 is also aligned with the line defined by these bores 20. Thus, these four bores 20 define four available positions for movable stop base. It will be appreciated that these aligned bores 20 cannot be formed so closely together as to partially overlap one another. Thus, the ability to position the movable stop assembly is limited by the sizes of these aligned bores 20. In other words, since the axial distance between adjacent bores 20 must be greater than the diameters of those bores 20** to prevent partial overlapping, the movable stop assembly can be positioned only in increments defined by such axial distance.

In order to permit more precise positioning of the movable stop assembly, however, the fifth bore 20 is not aligned with the other four bores 20. Rather, the fifth bore 20 is located on the opposite side of the longitudinal axis **10*a*. A second aperture 23 is formed through the stop base 16 which is longitudinally aligned with the fifth bore 20. The retaining pin 22 may be inserted through the second aperture 23 and into the fifth bore 20, in a manner similar to that described above, to retain the movable stop assembly in a fifth available position defined by this bore 20. Other bores (not shown) may be formed in the stop base in longitudinal alignment with this fifth bore to define additional available positions for the movable stop assembly. By providing pluralities of bores 20 on both sides of the longitudinal axis 10*a* (and the corresponding aligned apertures 21 and 23**), the movable stop assembly may be positioned in axially adjacent positions which are much closer together than would otherwise be possible.

Adjacent to the slide base assembly 12 is a stripper arm assembly, indicated generally at 30. The stripper arm assembly 30 includes a stripper arm 31. The lower end of the stripper arm 31 is secured to the base plate 11 of the press 10, preferably far to one side of the longitudinal axis **10*a* as shown in FIG. 4. The stripper arm 31 extends upwardly, then over such that the upper end thereof is disposed over the longitudinal axis 10*a*. A depending rubber bumper 32 is secured to the upper end of the stripper arm 31. The function of the stripper arm assembly 30** will be explained in detail below.

Adjacent to the stripper arm assembly 30 is a pivot block assembly, indicated generally at 40. The pivot block assembly 40 includes a pivot base 41, which is disposed in a recess **11*a* formed in the base plate 11. As will be subsequently described, a second recess 11*b* is also formed in the base plate 11 to receive the pivot base 41. The upper surface of the pivot base 41 has a semi-cylindrical recess 41*a* formed therein, within which a cylindrical pivot bar 42 is disposed. A pivot lid 43 is provided with a similar semi-cylindrical recess 43*a* in its lower surface. The pivot bar 42 is received within the recess 43*a* such that the pivot lid 43 is pivotable thereabout relative to the pivot base 41 and the base plate 11 of the press 10. The function of the pivot block assembly 40** will be explained in detail below.

Adjacent to the pivot block assembly 40 is a knockout assembly, indicated generally at 50. The knockout assembly 50 includes a knockout plate 51 which is carried on a plurality of knockout pins 52. The knockout pins 52 extend downwardly through respective apertures formed through the base plate 11 of the press 10. The knockout pins 52 are themselves supported or carried on any conventional resilient means (not shown), such as springs or compressed air. As a result, the knockout plate 51 is resiliently supported above the base plate 11, as shown in FIG. 1. The function of the knockout assembly 50 will be explained in detail below.

Lastly, adjacent to the knockout assembly 50 is a bending bar assembly, indicated generally at 55. The bending bar assembly 55 includes a bending bar 56 and one or more shims 57 (only one is illustrated). The bending bar 56 and the shim 57 are secured to the base plate 11 by any conventional means. The shim 57 is provided (when necessary) to support the bending bar 56 above the upper surface of the base plate 11 by a predetermined distance. The function of the bending bar assembly 55 will be explained in detail below.

As best shown in FIG. 4, a first die holder 60 is secured to the bottom plate 11 of the press 10 on one side of the longitudinal axis 10*a*. The first die holder 60 has a central recessed area 60*a* formed therein which faces toward the longitudinal axis 10a. A pair of cylindrical positioning pins 60*b* and 60*c* are secured to the first die holder 60 and extend outwardly from the recessed area 60*a* toward the longitudinal axis 10*a*. The first positioning pin 60*b* has an outer diameter which is larger than the outer diameter of the second positioning pin 60*c*, for reasons which will be discussed below. Similarly, a second die holder 61 is secured to the bottom plate 11 of the press 10 on the opposite side of the longitudinal axis 10*a*. The second die holder 61 is identical in shape to the first die holder 60, including a central recessed area 61*a* and a pair of positioning pins 61b and 61*c* extending outwardly therefrom.

The first die holder 60 is adapted to receive and retain a first die 62 in its recessed area 60*a*. The first die 62 has a pair of cylindrical bores 62*a* and 62*b* formed therein. When the first die 62 is moved into the recessed area 60*a* of the first die holder 60, the pins 60*b* and 60*c* are received within the bores 62*a* and 62*b*, respectively. The first and second bores 62*a* and 62*b* correspond in size to the first and second positioning pins 60*b* and 60*c*, respectively. Thus, the first bore 62*a* is larger in diameter than the second bore 62*b*. The different sizes of the pins 60*b* and 60*c* and the bores 62*a* and 62*b* allow the first die 62 to be oriented in only one position relative to the first die holder 60. For example, if the first die 62 was inadvertently flipped upside down relative to the first die holder 60, the larger positioning pin 60*b* would be aligned with the smaller bore 62*b*. Thus, the first die 62 could not be retained to the first die holder 60 in this upside down arrangement. This arrangement provides a level of error proofing which is important when the easily removable and interchangeable dies 62 and 63 are used, as will become further evident below.

Similarly, the second die holder 61 is adapted to receive and retain a second die 63 in its recessed area 61*a*. The second die 63 has a pair of cylindrical bores 63*a* and 63*b* formed therein. The first bore 63*a* is larger in diameter than the second bore 63*b*, corresponding in size to the first and second positioning pins 61*b* and 61*c*. Thus, it can been seen that the second die 63 can be oriented in only one position relative to the second die holder 61. However, the sizes of the first positioning pins 60*b* and 61*b* are the same, as are the sizes of the second positioning pins 60*c* and 61c. Thus, if desired, the first and second dies 62 and 63 may be reversed in the die holders 60 and 61. In other words, the second die 63 may retained in the first die holder 60, and the first die 62 may be retained in the second die holder 61. This reversed orientation may be desirable in certain instances described below.

Referring back to FIG. 1, the press 10 further includes a ram, the lower portion of which is illustrated at 70. As is well known in the art, the ram 70 is connected to the frame of the press 10 above the base plate 11 and is selectively movable downwardly toward the base plate 11. First and second support blocks 71 and 72 are carried by the ram 70 for movement therewith. As best shown in FIG. 4, the lower ends of the first and second support blocks 71 and 72 are formed having respective pairs of spaced apart depending arm portions 71*a* and 72*a*. A tapered surface 71*b* is provided between the two arm portions 71*a* of the first support block 71. The functions of the arm portions 71*a* and 72*a*, as well as that of the tapered surface 71*b*, will be described below.

A generally cylindrical pivot arm 75 is connected to the first and second support blocks 71 and 72. One end of the pivot arm 75 is pivotably connected by a pivot pin 76 to the depending arm portions 71*a* of the first support block 71. The other end of the pivot arm 75 is releasably connected to the depending arm portions 72*a* of the second support block 72 by a retainer pin 77. Thus, the pivot arm 75 is supported for selective pivoting movement about an axis defined by the pivot pin 76, which axis is oriented perpendicular to the longitudinal axis 10*a*. A stop 73 is secured to the lower end of the second support block 72 for a purpose which will be described below.

A punch 80 is supported on the ram 70 for movement therewith. The punch 80 is provided with an aperture 80*a* which extends therethrough parallel to the longitudinal axis 10*a*. The pivot arm 75 extends through the aperture 80*a* so as to support the punch 80 thereon. A keeper 81 is provided to releasably retain the punch 80 in a position adjacent to the first support arm 71. The keeper 81 is connected to the first support arm 71 by a threaded fastener 82 which extends through a slot 80*a*. The operation of the keeper 81 will be described in detail below.

Figure 6A:
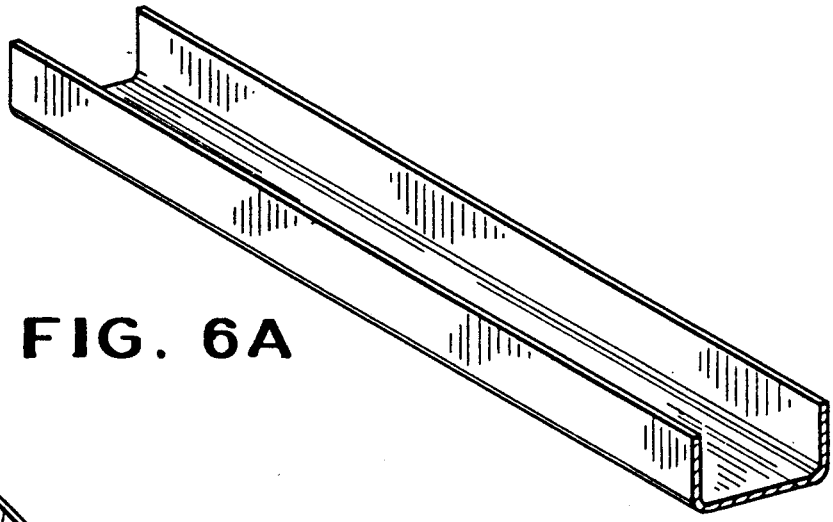
FIG. 6A is a perspective view of one type of vehicle side rail prior to being formed with an offset bend by the press illustrated in FIGS. 1 through 4.
Figure 6B:
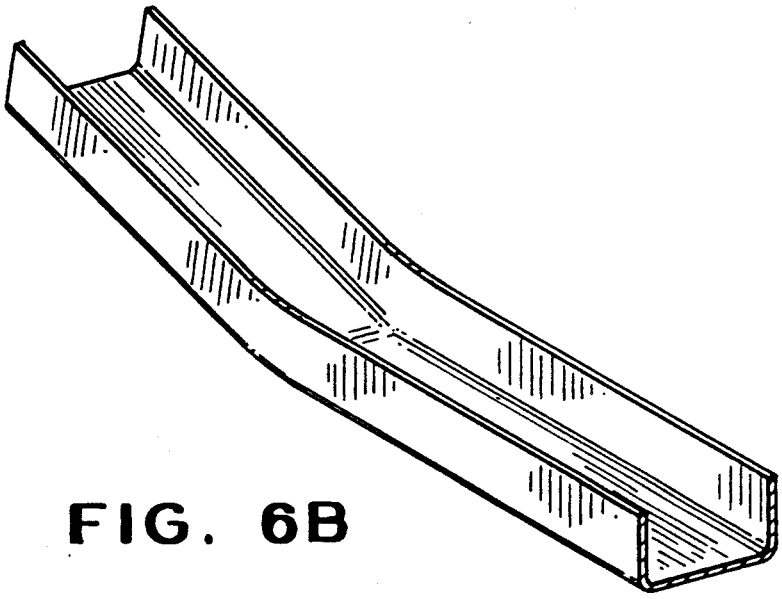
FIG. 6B is a perspective view of the vehicle side rail illustrated in FIG. 6A after having been formed with such an offset bend.

The basic operation of the press 10 will now be described in detail. For the purpose of illustration, the operation of the press 10 will be described in the context of forming an offset bend in a side rail for the frame of a vehicle. FIG. 6A shows the structure of one embodiment of such a side rail, which is composed of an elongated web portion having opposed perpendicular flange portions, prior to the offset bend being formed. FIG. 6B shows the shape of the side rail after the offset bend has been formed. As shown therein, the web portion of the side rail has been bent to form two linear regions which are angled relative to one another. The flange portions are bent in a similar manner. However, during the bending process, the flange portions are guided by the punch 80 and the first and second dies 62 and 63 so as not to buckle or otherwise become deformed, as will be discussed below. Although the operation of the press 10 will be described in this context, it will be appreciated that this invention is equally applicable to the formation of other workpieces.

FIG. 1 illustrates the initial position of the press 10. In this position, the ram 70 is disposed above the base plate 11. Before the press 10 is operated, the punch 80 is installed on the pivot arm 75. Also, a corresponding pair of dies 62 and 63 are installed on the respective die holders 60 and 62. As will be described in greater detail below, the punch 80 and the dies 61 and 63 are selected in accordance with the shape of the particular side rail 85 upon which the offset bend is to be made. Lastly, the movable stop assembly is moved and retained in a desired one of the plurality of available positions relative to the base plate 11, as described above.

Figure 2:
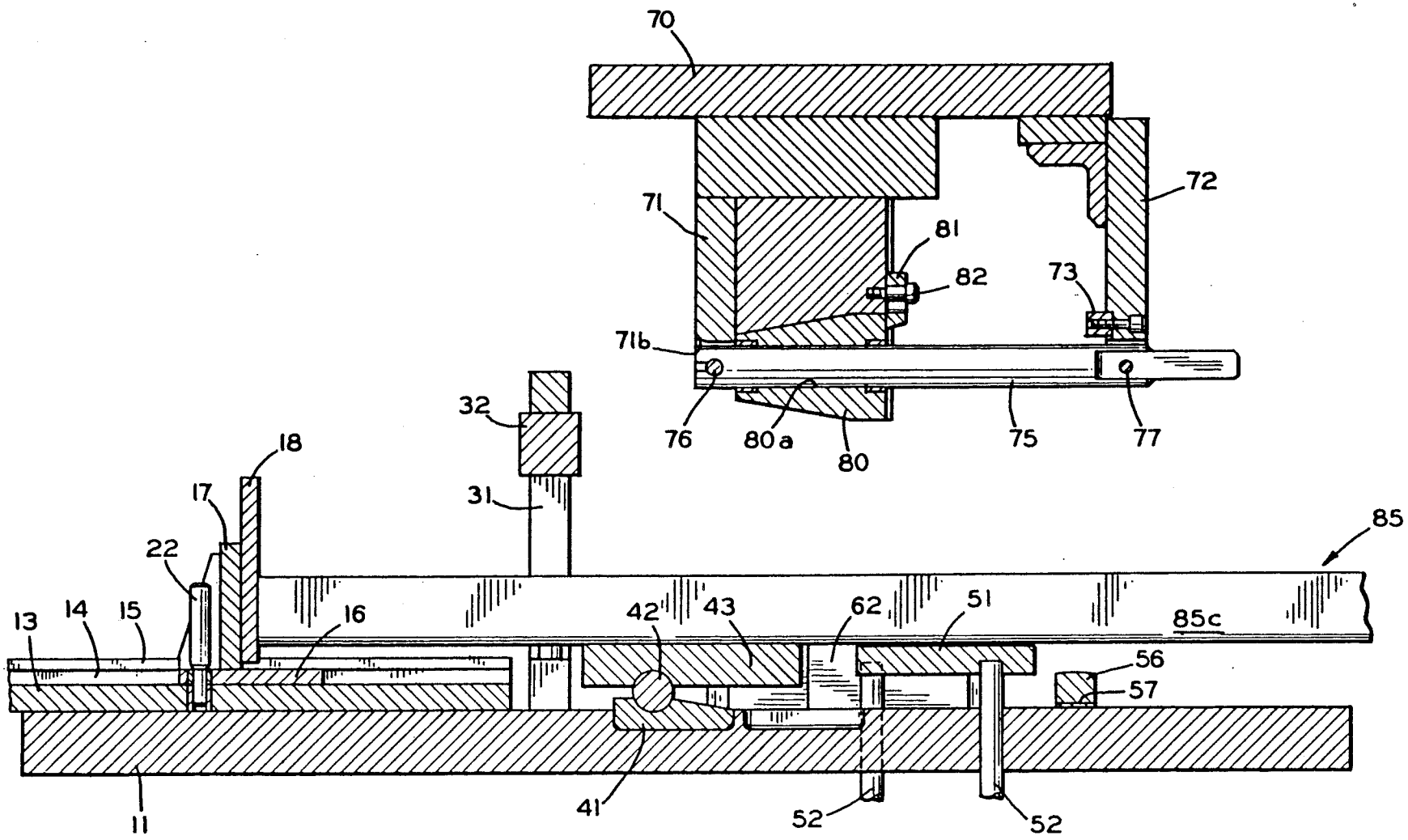
FIG. 2 is a side elevational view similar to FIG. 1 showing a workpiece, such as a side rail for a vehicle frame, inserted into the press prior to the beginning of the forming operation.

FIG. 2 illustrates a second embodiment of a side rail, indicated generally at 85, inserted within the press 10. Such insertion may be accomplished by first supporting the side rail 85 on a conventional conveyor (not shown) in alignment with the longitudinal axis 10*a* of the press 10. Then, the side rail 85 is moved along the conveyor such that the leading edge thereof enters within the press 10. During insertion, the conveyor maintains the side rail 85 in an elevated position above the base plate 11. Depending upon the specific elevation of the side rail 85, the leading edge thereof may engage the pivot lid 43 and cause it to pivot relative to the base plate 11. However, the side rail 85 is preferably maintained above and out of engagement with the knockout plate 51. The insertion of the side rail 85 is continued until the leading edge thereof engages the stop plate 18 of the movable stop assembly. When so engaged, the side rail 85 is properly located relative to the ram 70 for the subsequent formation of the offset bend. Lastly, the conveyor is lowered so that the weight of the side rail 85 is carried on the pivot lid 43 in preparation for the offset bend to be formed.

Figure 3:
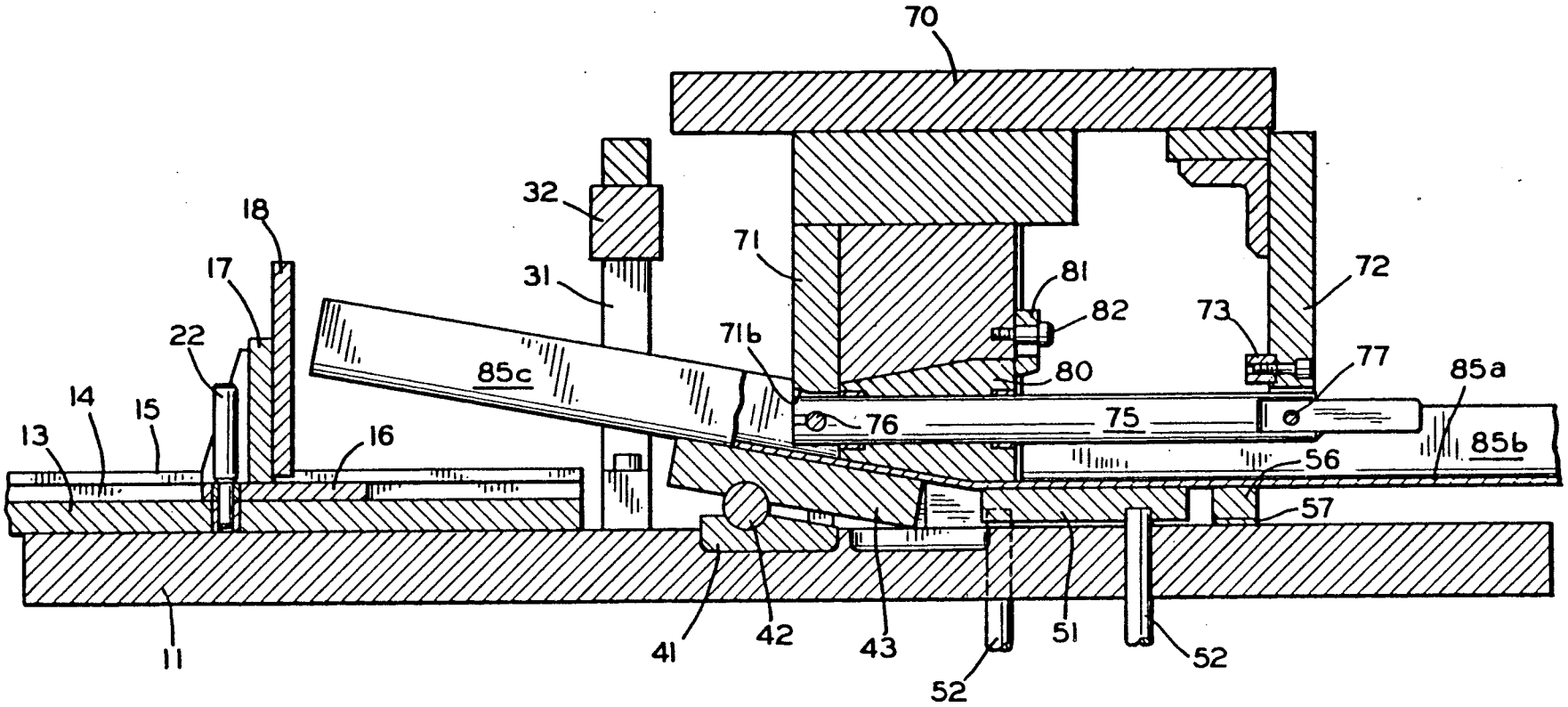
FIG. 3 is a side elevational view similar to FIG. 2 showing the press performing the forming operation.

FIG. 3 illustrates the ram 70 having been moved downwardly to form the offset bend in the side rail 85. In this position, the punch 80 exerts a force downwardly against the upper surface of a web portion 85*a* of the side rail 85, while the pivot lid 43 and the bending bar 56 engage the lower surface of the web portion 85*a* to resist such force. Thus, the offset bend is formed in the web portion 85*a* of the side rail 85. While this offset bend is being made, opposed sides 80*b* and 80*c* (see FIG. 4) of the punch 80 cooperate with the dies 61 and 63 to engage both flange portions 85*b* and 85*c* of the side rail 85. As mentioned above, this engagement is desirable to prevent the flange portions 85*b* and 85*c* from buckling or otherwise becoming deformed during the formation of the offset bend in the web portion 85*a*.

The shapes of the sides 80*b* and 80*c* of the punch 80 and the shapes of the dies 62 and 63 are determined by the shape of the side rail 85. As shown in FIG. 4, the offset bend may be formed in or near a region of the side rail 85 where the width of the flange portion 85*a* is not constant. Thus, the one flange portion 85*b* may not extend parallel or linear to the other flange portion 85*c*. In this instance, the sides 80*b* and 80*c* of the punch 80 and the dies 61 and 63 are shaped to follow the flange portions 85*b* and 85*c* of the side rail 85. This will prevent undesirable buckling or deformation of the flange portions 85*b* and 85*c* during the formation of the offset bend in the web portion 85*a*, as discussed above.

The side rail 85 shown in FIG. 4 is shaped somewhat differently than the side rail shown in FIGS. 6A and 6B, wherein the side rail has a constant width web portion throughout the region where the offset bend is to be formed. Accordingly, to form an offset bend in the side rail illustrated in FIGS. 6A and 6B, both the sides 80*b* and 80*c* of the punch 80 and the dies 62 and 63 would be shaped essentially flat so as to follow the flat parallel shapes of the flange portions.

Once the offset bend is formed, the ram 70 is retracted upwardly to the position illustrated in FIG. 1. The knockout assembly 50 pushes the formed side rail 85 upwardly so as to facilitate the removal thereof on the conveyor. The stripper arm assembly 30 is provided to knock the formed side rail 85 off of the punch 80 if the side rail happens to become stuck thereon. If this occurs, the retraction of the ram 70 lifts the punch 80 and the side rail 85 upwardly until the side rail 85 engages the rubber bumper 32 and disengages it from the punch 80.

Having described the basic operation of the press 10, the process by which the punch 80 and the dies 62 and 63 are changed for use on differently shaped side rails 85 will now be described. This tool changeover operation can be accomplished in two different manners, depending upon whether there is any relationship between the structure of the previous side rail (which has just been formed with an offset bend) and the structure of the next side rail (which is about to be formed with an offset bend). This invention provides a quick and simple means to accomplish this tool changeover operation in either situation.

In the first instance, the previous and next side rails are structurally related because they are designed for use as a matched or symmetric pair in a vehicle frame. In other words, for that particular vehicle frame, the left hand side rail is a mirror image of the right hand side rail. In these instances, the offset bend in the left hand side rail is located in the same relative position as on the right hand side rail. Because the side rails are opposite (but otherwise identical) in shape, the same punch 80 and dies 62 and 63 may be used to form both of the offset bends.

Figure 7:
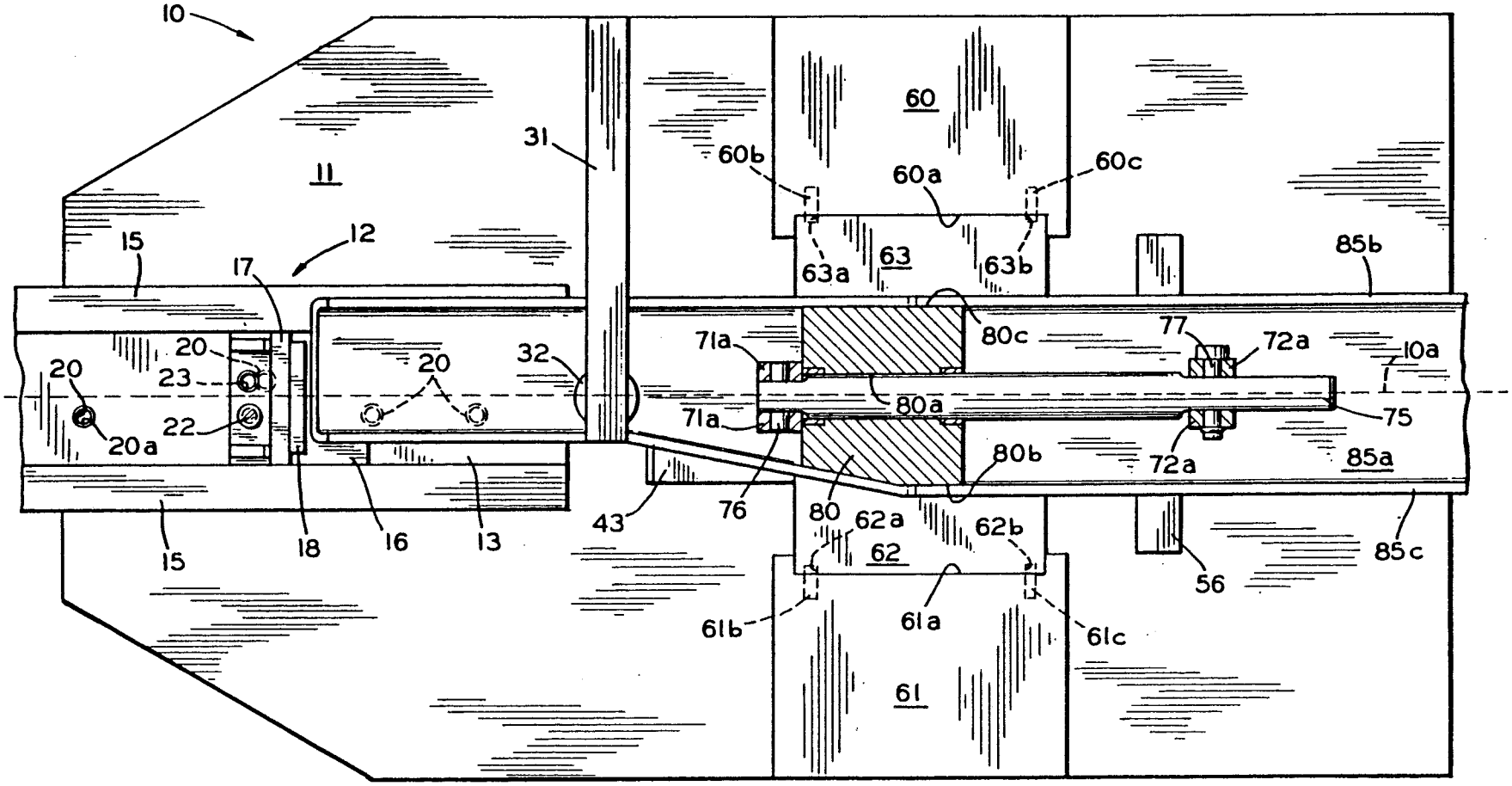
FIG. 7 is a top plan view, similar to FIG. 4, wherein the punch has been rotated one hundred eighty degrees about the pivot arm and the dies have been switched to the opposite die holders to form an offset bend in an opposite hand side rail.

For example, assume that the side rail 85 illustrated in FIG. 4 is a right hand side rail for a vehicle frame. As shown therein, the one flange portion 85*b* is engaged between the first die 62 and the one side 80*b* of the punch 80, while the other flange portion 85*c* is engaged between the second die 63 and the other side 80c of the punch 80. The corresponding left hand side rail 85' is illustrated in FIG. 7. To form the offset bend in the side rail 85', two simple operations must be performed. First, the dies 62 and 63 must be reversed so as to mount the first die 62 in the second die holder 61 and to mount the second die 63 in the first die holder 60. The switching of the dies 62 and 63 can be easily accomplished by pulling them out of their respective die holders 60 and 61 and installing them in the opposite die holders 61 and 60, respectively, as shown in FIG. 7. As noted above, the differently sized positioning pins 60*b*, 60*c* and 61*b*, 61*c* in the die holders 60 and 61 prevent the dies 62 and 63 from being incorrectly installed in the die holders 60 and 61 during this reversal.

Figure 8:
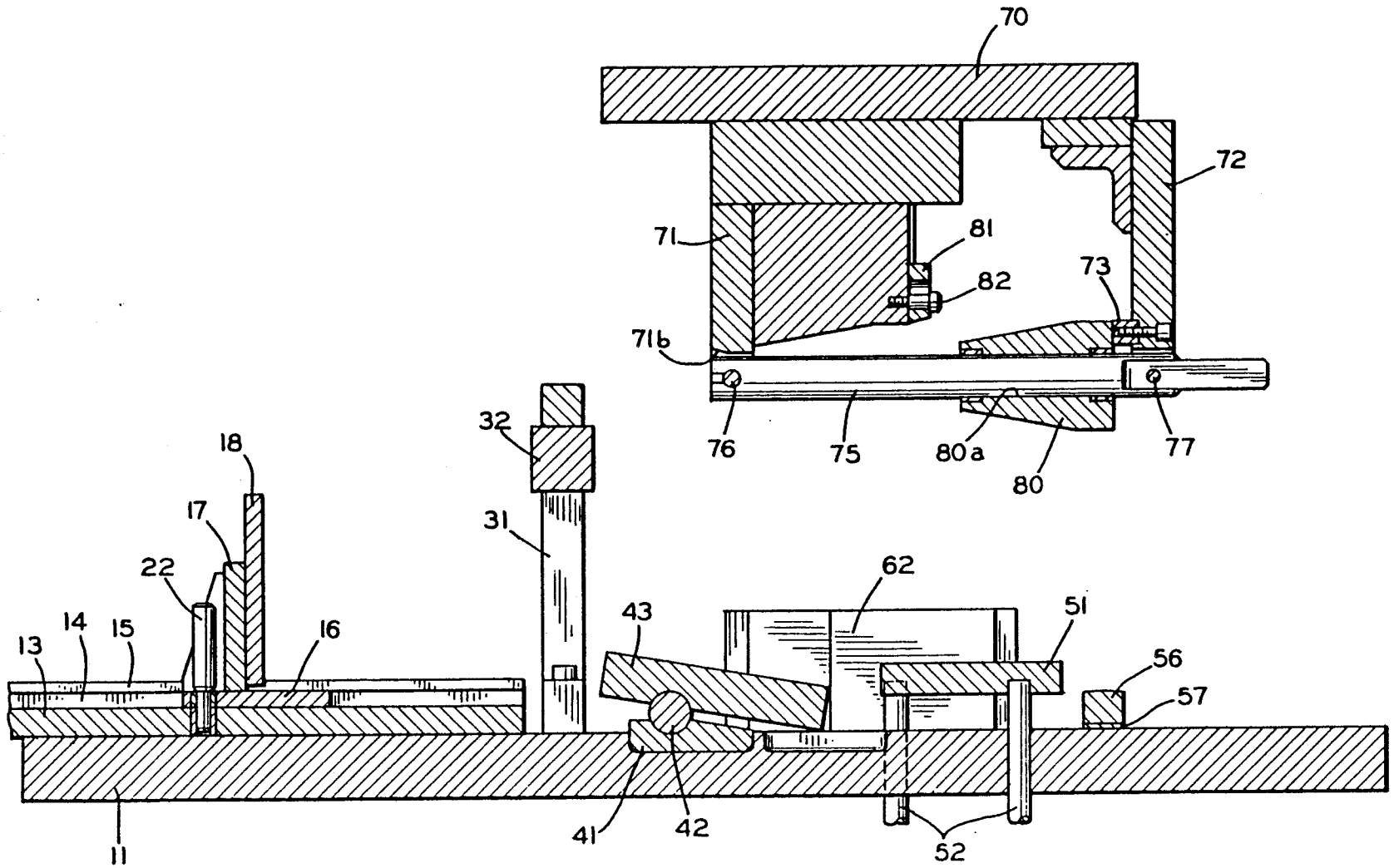
FIG. 8 is a side elevational view similar to FIG. 1 showing the punch after having been moved along the supporting pivot bar and rotated one hundred eighty degrees during a tool changeover operation.

The second operation which must be performed is to rotate the punch 80 one hundred eightly degrees about the pivot arm 75. The rotation of the punch 80 can be easily accomplished by raising the keeper 81 above the punch 80 (which is permitted by the provision of the slot 81*a* therein) and sliding the punch 80 along the pivot arm 75 toward the stop 73, as shown in FIG. 8. When engaged with the stop 73, the punch 80 is clear of the first support block 71 and can be rotated one hundred eighty degrees about the pivot arm 75. Then, the punch 80 can be moved back toward the first support block 71. The keeper 81 is provided with a lowered tapered surface 81*b* (see FIG. 8). This lower tapered surface 81*b* is engaged by the punch 80 and automatically raised upwardly during this return sliding movement. When the punch 80 is returned to its original position in engagement with the first support block 71, the keeper 81 automatically drops downwardly to retain the punch 80 in that position. Thus, the punch 80 and the dies 62 and 63 can be quickly and easily changed for forming the left hand side rail 85'.

In the second instance discussed above, the previously formed side rail and the next formed side rail are structurally unrelated, such as would occur if the side rails are intended for use in different vehicle frames. In this case, the same two basic operations (the changing of the dies 62 and 63 and the changing of the punch 80) still must be performed. Rather than switching the dies 62 and 63 in the die holders 60 and 61, as described above, the dies 62 and 63 are removed and replaced with other dies which are appropriately shaped for the next side rail.

Figure 9:
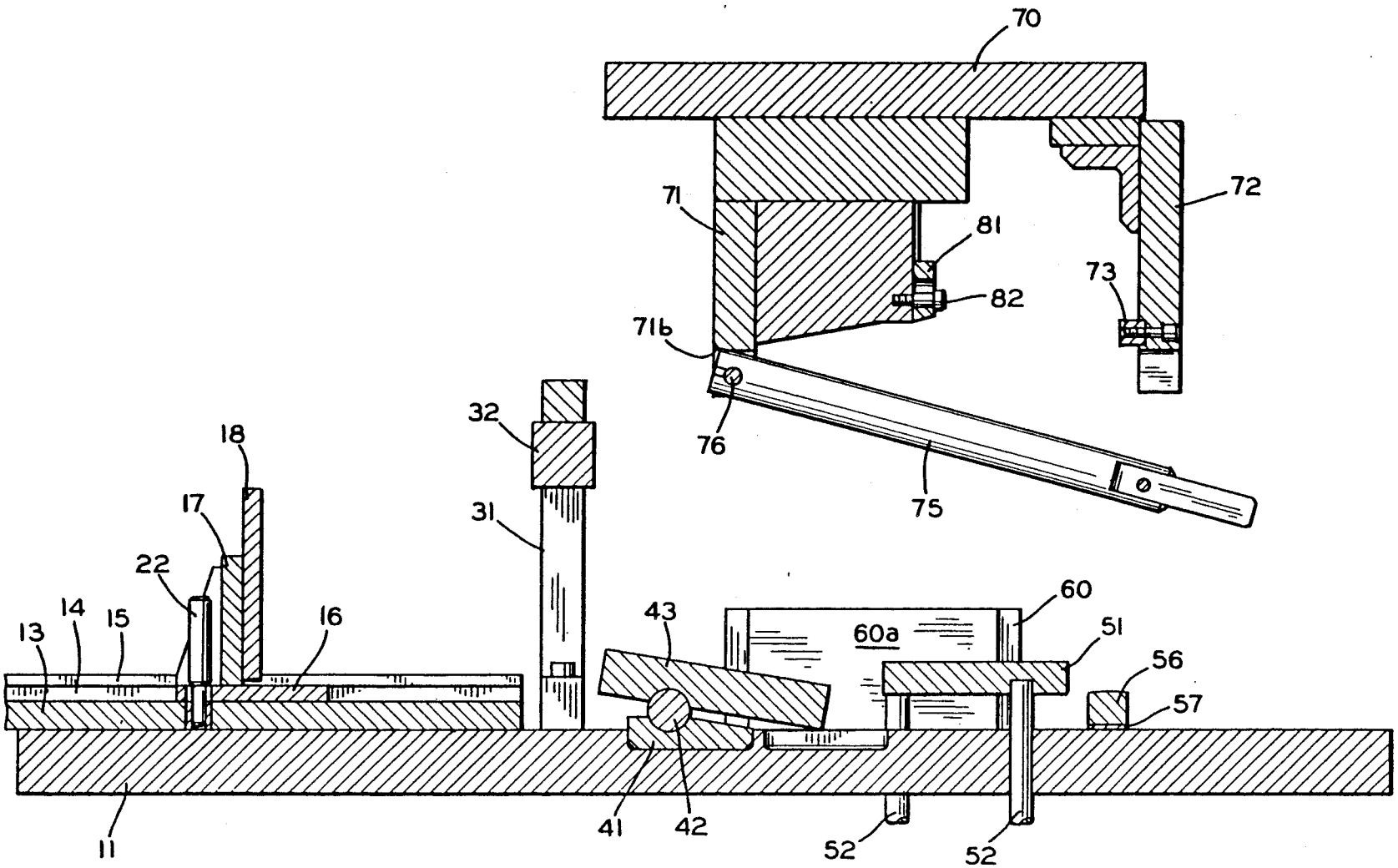
FIG. 9 is a side elevational view similar to FIG. 1 showing the supporting pivot bar after having been pivoted downwardly and the punch and dies removed during a tool changeover operation.

To change the punch 80, the retainer pin 77 is initially removed from the arm portions 72*a* of the second support block 72. This allows the pivot arm 75 to pivot downwardly, as illustrated in FIG. 9. As shown therein, the opposite end of the pivot arm 75 (adjacent to the pivot pin 76) engages the lower tapered surface 71*b* of the first support block 71 when the pivot arm 75 has been pivoted to a predetermined angle relative thereto. Therefore, the lower tapered surface 71*b* functions as a stop to limit the amount of pivoting movement of the pivot arm 75. When so pivoted, the punch 80 can slide off of the pivot arm 75. A different punch can be installed while the pivot arm 75 is in this pivoted position. Then, the pivot arm 75 can be returned to its original position and secured to the second support block 72 by the retainer pin 77. Lastly, the newly installed punch is slid back into engagement with the first support block 71, as described above, for use.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. In a press machine including a base plate for supporting a workpiece and a ram selectively movable toward the base plate, a means for removably supporting a tool on the ram so as to engage the workpiece when the ram is moved toward the base plate comprising:

a pivot arm adapted to support the tool thereon, said pivot arm having first and second ends;

means for pivotably connecting said first end of said pivot arm to the ram, said pivot arm being movable between a first position, wherein the tool is supported for engagement with the workpiece when the ram is moved toward the base plate, and a second position, wherein the tool may be removed from said pivot arm;

means for releasably connecting said second end of said pivot arm to the ram to retain said pivot arm in said first position.

2. The invention defined in claim 1 wherein said means for pivotably connecting includes a pair of depending arm portions formed on the ram, said first end of said pivot are being pivotably connected to said depending arms.

3. The invention defined in claim 2 wherein said depending arms and said first end of said pivot arm have aligned apertures formed therethrough, and wherein said means for pivoting connecting further includes a pivot pin extending through said depending arm apertures and said pivot arm aperture to pivotably connect said first end of said pivot arms to depending arm portions of the ram.

4. The invention defined in claim 1 wherein said means for releasably connecting includes a pair of depending arm portions formed on the ram, said second end of said pivot arm being releasably connected to said depending arms.

5. The invention defined in claim 1 wherein said depending arms and said second end of said pivot arm have aligned apertures formed therethrough, and wherein said means for releasably connecting further includes a retainer pin insertable through said depending arm apertures and said pivot arm aperture to releasably connect said second end of said pivot arm to depending arm portions of the ram.

6. In a press machine including a base plate for supporting a workpiece and a ram selectively movable toward the base plate, a means for supporting a tool on the ram so that a surface of the tool engages the workpiece when the ram is moved toward the base plate comprising:

a tool having an aperture formed therethrough and a plurality of workpiece engaging surfaces; and an arm connected to the ram, said arm extending through said aperture so as to support said tool thereon, said tool being selectively movable along said arm between a first tool position, wherein said tool may be moved relative to said arm to select one of said plurality of surfaces for engagement with the workpiece, and a second tool position, wherein said tool is supported such that said selected one of said plurality of surfaces is exposed for engagement with the workpiece when the ram is moved toward the base plate.

7. The invention defined in claim 6 further including means for selectively retaining said tool in said second tool position.

8. The invention defined in claim 7 wherein said means for selectively retaining includes a keeper connected to the ram and movable between a first keeper position, wherein said keeper is positioned to block movement of said tool out of said second tool position on said arm, and a second keeper position, wherein said keeper is not position to block movement of said tool out of said second tool position on said arm.

9. The invention defined in claim 8 wherein said first keeper position is an upper position and said second keeper position is a lower position, whereby the force of gravity urges said keeper toward said second keeper position.

10. The invention defined in claim 8 wherein said keeper has a surface formed thereon which is engaged by said tool when said tool is moved from said first tool position to said second tool position to automatically move said keeper from said second keeper position to said first keeper position.

11. In a press machine including a base plate for supporting a workpiece, a ram selectively movable toward the base plate, and a tool supported on the ram for engaging the workpiece when the ram is moved toward the base plate, a means for positioning the workpiece relative to the base plate such that the tool engaged the workpiece at a desired location comprising:

a bottom plate adapted to be supported on the base plate, said bottom plate having a plurality of apertures formed therein;

a movable stop assembly supported on said bottom plate, said movable stop assembly including a stop base having an aperture formed therethrough and a stop plate connected to said stop base, said stop plate adapted to be engaged by the workpiece when inserted within the press machine; and a retaining pin extending through said stop base aperture and into one of said plurality of bottom plate apertures so as to locate said stop plate in a desired one of a plurality of predetermined discrete postions relative to the base plate, said plurality of predetermined discrete positions being defined by the locations of said bottom plate apertures.

12. The invention defined in claim 11 further including means for retaining said stop assembly on said bottom plate while permitting movement therealong.

13. The invention defined in claim 12 wherein said retaining means includes a keeper bar extending over an upper portion of said stop base.

14. The invention defined in claim 11 wherein said plurality of bottom plate apertures are aligned with the axis of movement of said movable stop assembly.

15. The invention defined in claim 14 wherein at least one additional aperture is formed in said bottom plate which is not aligned with said aligned bottom plate apertures.

16. The invention defined in claim 15 wherein said stop base has a second aperture formed therethrough such that said retaining pin may extend through said second stop base aperture into said additional bottom plate aperture so as to locate said stop plate in an additional desired position relative to the base plae, said additional desired position being defined by the location of said additional bottom plate aperture.

* * * * *

UNITED STATES PATENT AND TRADEMARK OFFICE

CERTIFICATE OF CORRECTION

PATENT NO. : 5,001,922

DATED : March 26, 1991

INVENTOR(S) : Daniel Kranis, Sr. et al

It is certified that error appears in the above-identified patent and that said Letters Patent is hereby corrected as shown below:

COLUMN 9:

Claim 2, line 4, change "are" to -- arm --.

Claim 3, line 4, change "pivoting" to -- pivotably --;

line 7, change "arms" to -- arm --.

COLUMN 10:

Claim 5, line 1, change "1" to -- 4 --.

Claim 8, line 7, change "position" to -- positioned --.

Claim 11, line 6, change "engaged" to -- engages --.

COLUMN 12:

Claim 16, line 6, change "plae" to -- plate --.

Signed and Sealed this

Twenty-eighth Day of July, 1992

*Attest:*

DOUGLAS B. COMER

*Attesting Officer*

*Acting Commissioner of Patents and Trademarks*